US010392738B2

(12) United States Patent
Oh et al.

(10) Patent No.: US 10,392,738 B2
(45) Date of Patent: Aug. 27, 2019

(54) CLOTHES TREATING APPARATUS AND METHOD FOR CONTROLLING SAME

(71) Applicant: LG ELECTRONICS INC., Seoul (KR)

(72) Inventors: Joohyeon Oh, Seoul (KR); Jayoen Kim, Seoul (KR); Mina Suh, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 251 days.

(21) Appl. No.: 15/322,533

(22) PCT Filed: Jun. 19, 2015

(86) PCT No.: PCT/KR2015/006240
§ 371 (c)(1),
(2) Date: Dec. 28, 2016

(87) PCT Pub. No.: WO2016/010269
PCT Pub. Date: Jan. 21, 2016

(65) Prior Publication Data

US 2017/0175316 A1 Jun. 22, 2017

(30) Foreign Application Priority Data

Jul. 15, 2014 (KR) ..... 10-2014-0088867

(51) Int. Cl.
*D06F 39/00* (2006.01)
*A47G 25/20* (2006.01)
(Continued)

(52) U.S. Cl.
CPC ..... *D06F 39/005* (2013.01); *A47G 25/20* (2013.01); *D06F 39/003* (2013.01);
(Continued)

(58) Field of Classification Search
CPC .... D06F 39/005; D06F 39/003; D06F 39/008; D06F 39/02; D06F 39/04; D06F 33/00;
(Continued)

(56) References Cited

FOREIGN PATENT DOCUMENTS

CN 101348985 1/2009
CN 102268802 12/2011
(Continued)

OTHER PUBLICATIONS

WO2012095390A1 with machine translation (Year: 2012).*
(Continued)

*Primary Examiner* — Michael E Barr
*Assistant Examiner* — Tinsae B Ayalew
(74) *Attorney, Agent, or Firm* — Ked & Associates, LLP

(57) ABSTRACT

A clothes treating apparatus comprises an operation unit, a main course selection unit having a plurality of main courses displayed around the operation unit, a memory to store the number of times by which a main course has been selected through the main course selection unit, a control unit to drive the clothes treating apparatus according to the selected main course. The main course selection unit displays one or more main course which have been selected through the main course selection unit more than a predetermined number of times during a predetermined period; and receives a selection of one course among the one or more displayed main courses according to the rotation of the operation unit. Frequently used courses or configuration factors may be displayed in a course selection unit and a sub-course input unit, thereby shortening the time for operating the clothes treating apparatus.

10 Claims, 8 Drawing Sheets

(51) Int. Cl.

| | |
|---|---|
| ***D06F 39/02*** | (2006.01) |
| ***D06F 39/04*** | (2006.01) |
| ***D06F 58/10*** | (2006.01) |
| ***D06F 58/28*** | (2006.01) |
| *D06F 33/02* | (2006.01) |
| *D06F 33/00* | (2006.01) |

(52) U.S. Cl.

CPC ..... *D06F 39/008* (2013.01); *D06F 39/02* (2013.01); *D06F 39/04* (2013.01); *D06F 58/10* (2013.01); *D06F 58/28* (2013.01); *D06F 33/00* (2013.01); *D06F 33/02* (2013.01); *D06F 2202/00* (2013.01); *D06F 2202/10* (2013.01); *D06F 2202/12* (2013.01); *D06F 2214/00* (2013.01)

(58) Field of Classification Search

CPC ..... D06F 33/02; D06F 58/10; D06F 58/28; D06F 2202/00; D06F 2202/10; D06F 2202/12; D06F 2214/00; A47G 25/20

USPC ..... 68/3 R

See application file for complete search history.

(56) References Cited

FOREIGN PATENT DOCUMENTS

| | | |
|---|---|---|
| DE | 103 07 756 | 9/2004 |
| EP | 1 898 283 | 3/2008 |
| JP | 2008-073425 | 4/2008 |
| KR | 10-0393999 | 8/2003 |
| KR | 10-2009-0086747 | 8/2009 |
| KR | 10-1083515 | 11/2011 |
| KR | 10-2012-0028664 | 3/2012 |
| WO | WO 2012/095390 | 7/2012 |

OTHER PUBLICATIONS

European Search Report dated Feb. 1, 2018 issued in Application No. 15821966.7.

Chinese Office Action dated Jun. 4, 2018 issued in CN Application No. 201580036707.0.

International Search Report and Written Opinion dated Sep. 4, 2015 issued in Application No. PCT/KR2015/006240 (with English Translation).

* cited by examiner

CLOTHES TREATING APPARATUS AND METHOD FOR CONTROLLING SAME

CROSS-REFERENCE TO RELATED PATENT APPLICATIONS

This application is a U.S. National Stage Application under 35 U.S.C. § 371 of PCT Application No. PCT/KR2015/006240, filed Jun. 19, 2015, which claims priority to Korean Patent Application No. 10-2014-0088867, filed Jul. 15, 2014, whose entire disclosures are hereby incorporated by reference.

TECHNICAL FIELD

The present invention relates to a clothes treating apparatus (particularly, washing machine) and a method for controlling the same, and more particularly, to a clothes treating apparatus and a method for controlling the same, in which functions (particularly, washing course) frequently used by the clothes treating apparatus are memorized by the clothes treating apparatus and first displayed on a course selection unit to allow a user to select a desired one of the displayed functions, thereby reducing an operation time of the clothes treating apparatus.

BACKGROUND ART

Generally, a clothes treating apparatus includes a washing machine, a dryer, and a styler, wherein the washing machine may include a drying function.

Also, the washing machine may be categorized into a pulsator washing machine in which a drum is arranged in a vertical direction, and a drum washing machine in which a drum is arranged in a horizontal direction.

The washing machine may be driven by a manipulation of a main course selection unit and/or a sub-course input unit, which is provided outside the washing machine, after washing targets and laundry detergent are put into the washing machine.

A user may select one of a plurality of courses through the main course selection unit, and may input setup factors according to the selected course through the sub-course input unit.

At this time, the plurality of courses may include a standard washing course, a baby clothes course, a boiling course, a speed wash course, a lingerie course, and a bedding course, and the setup factors may include the number of rinse times, spin strength, and washing water temperature.

If a user pushes a power button of the clothes treating apparatus, the plurality of courses are displayed on the course selection unit. At this time, the user may select a desired one of the plurality of courses.

After one course is selected, the user may respectively input the plurality of setup factors.

However, courses used by the user are limited to a part of the plurality of courses. Also, the plurality of setup factors are also limited to values of frequently used factors in accordance with a taste of the user.

In case of the aforementioned clothes treating apparatus, after a power source is input to the clothes treating apparatus, there is inconvenience in that the user should select a desired course after always identifying all of courses displayed on the course selection unit.

Particularly, if the course selection unit is formed in a dial shape, since each course can be selected in accordance with rotation of the dial, there is inconvenience in that the user should select a course by turning the dial after identifying positions of all of the courses.

Also, there is inconvenience in that the plurality of setup factors should be input whenever the clothes treating apparatus is input in accordance with the selected course.

Also, a problem occurs in that one of family members, who does not use the clothes treating apparatus frequently, has a difficulty in identifying which course of the plurality of courses displayed on the course selection unit should be selected or which value should be input to the plurality of setup factors displayed on the sub-course input unit.

DISCLOSURE

Technical Problem

The present invention is devised to solve the above inconvenience and problems, and an object of the present invention is to provide a clothes treating apparatus and a method for controlling the same, in which one or more frequently used courses of a plurality of courses are only displayed on a main course selection unit to increase manipulation convenience of a user.

Also, another object of the present invention is to provide a clothes treating apparatus and a method for controlling the same, in which frequently input setup factors of a plurality of setup factors according to selected courses are displayed on a sub-course input unit to increase manipulation convenience of a user.

Also, still another object of the present invention is to provide a clothes treating apparatus and a method for controlling the same, in which frequently used courses and setup factors are displayed on a main course selection unit and a sub-course input unit to reduce an operation time of the clothes treating apparatus.

Also, further still another object of the present invention is to provide a clothes treating apparatus and a method for controlling the same, in which a family member who does not use the clothes treating apparatus frequently can easily use the clothes treating apparatus.

Technical Solution

To achieve the aforementioned objects of the present invention, a clothes treating apparatus, which comprises a cabinet for forming external appearance and a drum rotatably installed inside the cabinet, receiving treating targets therein, comprises a main course selection unit formed to display a plurality of courses and select one of the plurality of courses; a memory formed to memorize the number of selection times of the course selected through the main course selection unit; and a controller formed to drive the clothes treating apparatus in accordance with the course selected through the main course selection unit, wherein the controller controls the main course selection unit to display only one or more courses on the main course selection unit if it is determined that the one or more courses of the plurality of courses are selected as much as the number of predetermined times or more through the main course selection unit for a predetermined period.

At this time, the main course selection unit includes a manipulation unit formed to select a course by rotation and a display unit for displaying a plurality of courses along a circumference of the manipulation unit, and the plurality of courses displayed on the display unit may be formed to be selectively lighted by a light emitting unit provided on a rear surface of the display unit.

Also, the controller may control the light emitting unit to allow only the one or more courses selected as much as the number of predetermined times or more for the predetermined period among the plurality of courses displayed on the display unit to be lighted by the light emitting unit.

Also, the controller may control the main course selection unit to allow one of the courses lighted by the light emitting unit to be selected in accordance with rotation of the manipulation unit.

Also, the controller may control the light emitting unit to allow all of the plurality of courses displayed on the display unit to be lighted by the light emitting unit if the manipulation unit is rotated at a predetermined angle or more.

Also, the treating apparatus may further comprise a plurality of indicator lights at positions corresponding to the plurality of courses between the manipulation unit and the plurality of courses.

At this time, the indicator lights provided at the positions corresponding to the displayed courses may be sequentially lighted in accordance with rotation of the manipulation unit.

Meanwhile, the clothes treating apparatus may further comprise a sub-course input unit formed to display one course selected by the main course selection unit and additional setup factors for executing the selected course and re-input or change-input the setup factors.

At this time, if the controller determines that there are setup factors input through the sub-course input unit as much as the number of predetermined times or more for a predetermined period, the controller may control the sub-course input unit to first display the setup factors on the sub-course input unit, and if the controller determines that there are no setup factors input through the sub-course input unit as much as the number of predetermined times or more for a predetermined period, the controller may control the sub-course input unit to display previously setup factors on the sub-course input unit in accordance with each course.

Also, the controller may receive information of the number of selection times of a clothes treating course selected through the course selection unit from the memory for a predetermined period.

Also, the present invention relates to a method for controlling a clothes treating apparatus, and specifically provides a method for controlling a clothes treating apparatus comprising a manipulation unit, a main course selection unit having a plurality of courses displayed on a circumference of the manipulation unit, a memory formed to memorize the number of selection times of a main course selected through the main course selection unit, and a controller formed to drive the clothes treating apparatus in accordance with the selected main course, the method comprising the steps of a power input step; a selection display step for displaying one or more main courses selected through the main course selection unit as much as the number of predetermined times or more for a predetermined period; and selection step for selecting one of the one or more displayed main courses through rotation of the manipulation unit.

At this time, the method for controlling a clothes treating apparatus may further comprise the steps of determining in the controller whether a predetermined period has passed after a first operation of the clothes treating apparatus, and determining in the controller whether there are main courses selected as much as the number of predetermined times or more for the predetermined period if the predetermined period has passed, before the display step.

Also, if it is determined that there are one or more main courses selected as much as the number of predetermined times or more for the predetermined time, the one or more main courses selected as much as the number of predetermined times or more may be displayed on the main course selection unit.

Also, the method for controlling a clothes treating apparatus may further comprise a memorizing step for memorizing the selected main courses in the memory after the selection step.

At this time, if it is determined that the predetermined period has not passed or there are no one or more main courses selected as much as the number of predetermined times or more, the method for controlling a clothes treating apparatus may further comprise a display step for displaying all main courses on the main course selection unit; a selection step for selecting one of all the displayed main courses; and a memorizing step for memorizing the selected main course in the memory.

Also, after the selection display step for displaying the one or more main courses selected as much as the number of predetermined times or more on the main course selection unit, if the manipulation unit is rotated at a predetermined angle or more, all of the plurality of main courses displayed on the main course selection unit may be displayed.

At this time, the predetermined angle may be 360°.

Also, the method for controlling a clothes treating apparatus, after the selection step for selecting one of the one or more displayed main courses, may further comprise the step of determining through the controller whether there are setup factors repeatedly input as number as the number of predetermined times or more in setup factors added to the selected main courses.

At this time, if there are setup factors repeatedly input as the number of predetermined times or more, the method for controlling a clothes treating apparatus may further comprise the steps of displaying the repeatedly input setup factors on a sub-course input unit; and operating the clothes treating apparatus through the setup factors displayed on the sub-course input unit.

Meanwhile, if there are no setup factors repeatedly input as the number of predetermined times or more, the method for controlling a clothes treating apparatus may further comprise the steps of displaying previously set standard setup factors on a sub-course input unit; and operating the clothes treating apparatus through the standard setup factors.

At this time, the setup factors may be configured to be variable by re-input of a user.

Also, the main course may include at least one or more of a standard washing course, a baby clothes course, a boiling course, a speed wash course, an allergy care course, a steam cleaning course, a functional clothes course, a bedding cleaning course, a cool water washing course, a lingerie/wool course, a bedding course, and rinsing/dehydrating courses, and the setup factors includes at least one or more of dehydrating strength, the number of rinsing times, dehydrating strength and water temperature.

Also, the controller may receive information of the number of selection times of the main course selected through the main course selection unit and information of the number of repeatedly input times of the setup factors input through the sub-course input unit from the memory for the predetermined period.

Advantageous Effects

According to the present invention, one or more frequently used courses of a plurality of courses may only be displayed on a main course selection unit, whereby manipulation convenience of a user may be increased.

Also, according to the present invention, frequently input setup factors of a plurality of setup factors according to selected courses may be displayed on a sub-course input unit, whereby manipulation convenience of a user may be increased.

Also, according to the present invention, frequently used courses and setup factors may be displayed on a main course selection unit and a sub-course input unit, whereby an operation time of the clothes treating apparatus by a user may be reduced.

Also, according to the present invention, a family member who does not use the clothes treating apparatus frequently can easily use the clothes treating apparatus.

BEST MODE FOR CARRYING OUT THE INVENTION

Hereinafter, the preferred embodiments of the present invention, which can achieve the above objects in detail, will be described with reference to the accompanying drawings. Although a clothes treating apparatus which will be described hereinafter includes a washing machine, a dryer, and a styler, a washing machine, which includes a drying function, will mainly be described.

Figure 1:
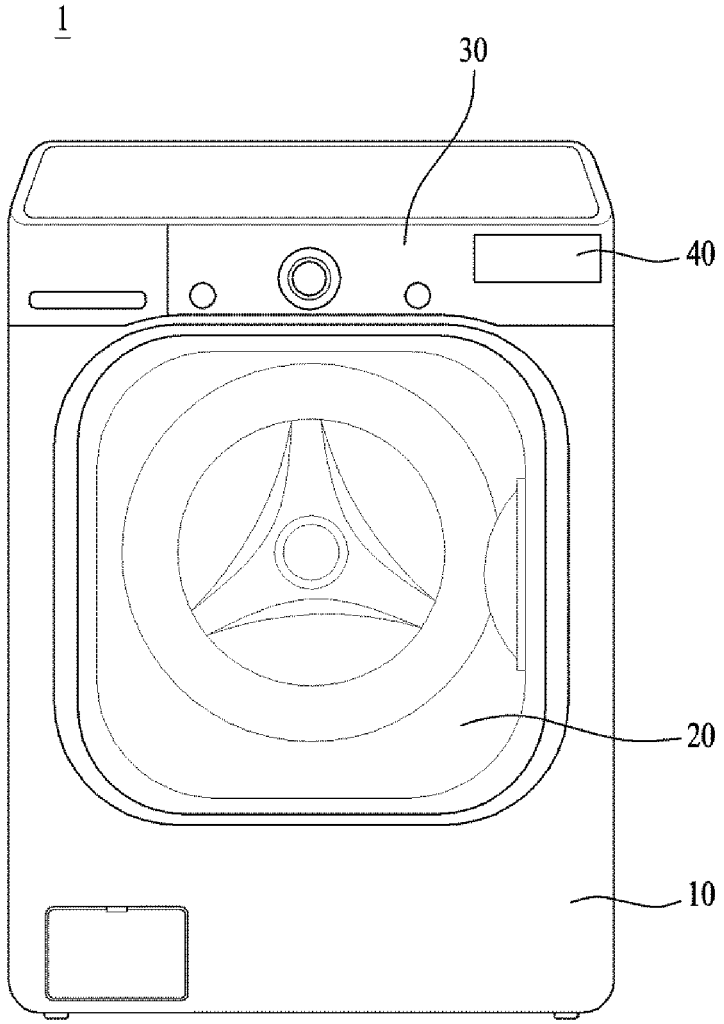
FIG. 1 is a front view illustrating a clothes treating apparatus according to the present invention.
Figure 2:
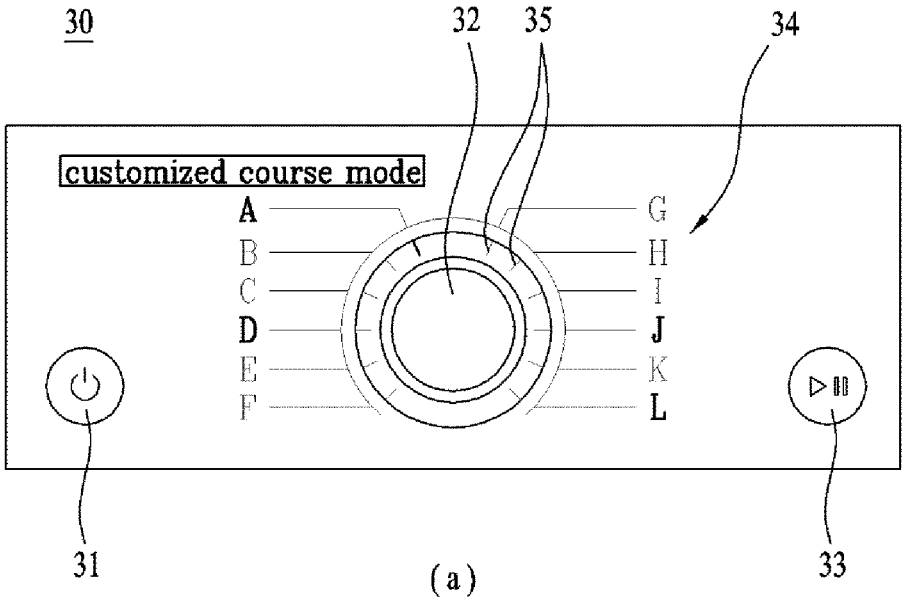
FIG. 2 shows views illustrating one embodiment of a main course selection unit (shown on the top with label (a)), and one embodiment of a sub-course input unit (shown on the bottom with label (b)).
Figure 2:
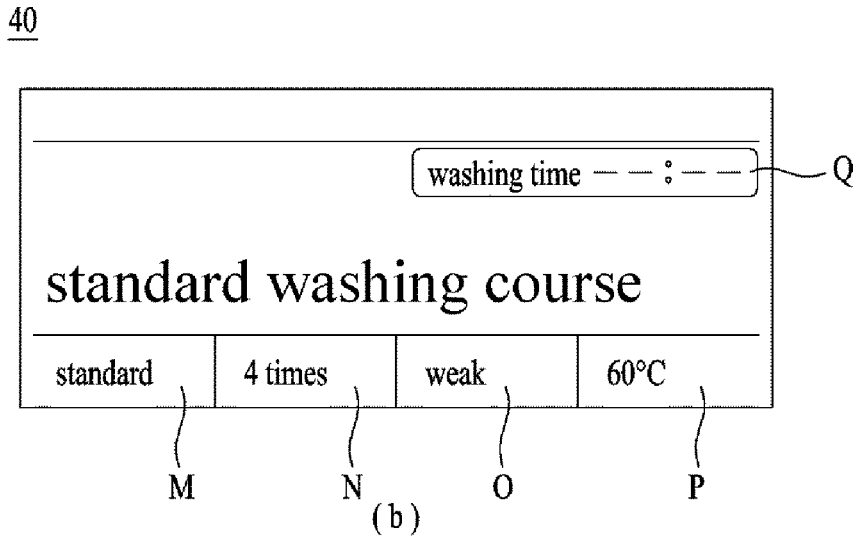

FIG. 1 is a front view illustrating a clothes treating apparatus according to the present invention, FIG. 2(*a*) is a view illustrating one embodiment of a main course selection unit, and FIG. 2(*b*) is a view illustrating one embodiment of a sub-course input unit.

Referring to FIG. 1, a clothes treating apparatus 1 according to the present invention may include a cabinet 10 forming external appearance, a door 20 that may be opened to receive clothes in the cabinet 10, a main course selection unit 30 and a sub-course input unit 40, wherein the main course selection unit 30 and the sub-course input unit 40 are provided on an outer surface of the cabinet 10.

In the shown embodiment, the main course selection unit 30 and the sub-course input unit 40 are provided at, but not limited to, an upper side of the door 20 on a front surface of the cabinet 10.

The door 20 is provided on a front surface of the cabinet 10, and may be formed to be opened through up-and-down rotation or left-and-right rotation.

A plurality of courses A to L for driving the clothes treating apparatus 1 may be displayed on the main course selection unit 30.

Also, one course selected by the main course selection unit 30 and additional setup factors for executing the selected course may be displayed on the sub-course input unit 40.

At this time, the setup factors may include the number of rinsing times, dehydrating strength and a water (washing water and rinsing water) temperature. These setup factors may be input, re-input or change-input through the sub-course input unit 40.

The main course selection unit 30 and the sub-course input unit 40 will be described in more detail with reference to FIGS. 2(*a*) and 2(*b*).

Referring to FIG. 2(*a*), the main course selection unit 30 includes a power button 31 for supplying a power source to the clothes treating apparatus, a manipulation unit 32 formed to select one of the plurality of courses A to L, a display unit 34 on which the plurality of courses A to L are displayed along the circumference of the manipulation unit 32, and an execution button 33 for executing the selected course through the manipulation unit 32.

To use the clothes treating apparatus, a user may supply a power source to the clothes treating apparatus through the power button 31.

Also, the course selection unit 30 may be provided with a plurality of indicator lights 35 between the manipulation unit 32 and the plurality of courses A to L. Also, the plurality of indicator lights 35 may respectively be provided at positions corresponding to the plurality of courses A to L between the manipulation unit 32 and the plurality of courses A to L.

The manipulation unit 32 may be formed in a rotatable rotary knob shape. That is, the user may select one of the plurality of courses A to L displayed on the main course selection unit 30 by rotating the rotary knob shaped manipulation unit 32.

In more detail, the plurality of courses A to L may be displayed on the main course selection unit 30 along the circumference of the manipulation unit 32, and the user may select one of the plurality of courses A to L by rotating the manipulation unit 32.

For example, as the manipulation unit 32 provided in the main course selection unit 30 is rotated, the indicator lights 35 provided at the positions corresponding to the plurality of courses A to L may be lighted (or activated) in due order.

At this time, after rotating the manipulation unit 32 until the indicator light 35 provided at the position corresponding to a desired one of the plurality of courses A to L is lighted, the user may drive the clothes treating apparatus 1 by pushing the execution button 33.

Meanwhile, when the user rotates the manipulation unit 32, the plurality of courses A to L and the indicator lights 35 displayed on the display unit 34 may be formed to be lighted sequentially or selectively by a light emitting unit 820 (see FIG. 4) provided on a rear surface of the display unit 34. Also, lighting of the plurality of courses A to L and the indicator lights 35 may be controlled through a controller 810 which will be described later with reference to FIG. 4.

Also, referring to FIG. 2(*b*), the setup factors such as washing strength 'M', the number of rinsing times 'N', dehydrating strength 'O', water (washing water/rinsing water) temperature 'P', and washing time 'Q' may be displayed on the sub-course input unit 40.

The sub-course input unit 40 may be formed in a touch screen shape that may input or change information of the setup factors through a touch based on a finger of the user.

Therefore, the user may input or change the setup factors such as washing strength 'M', the number of rinsing times 'N', dehydrating strength 'O', and water temperature 'P' through the sub-course input unit 40.

For example, the plurality of courses A to L provided in the main course selection unit 30 have setup factors previously set in accordance with the respective courses. That is, the setup factors such as washing strength 'M', the number of rinsing times 'N', dehydrating strength 'O', and water temperature 'P' are previously determined in each course.

Hereinafter, the setup factors which are previously determined in accordance with each course will be referred to as "standard setup factors".

Therefore, if the user selects a desired course from the main course selection unit 30, the setup factors (that is, standard setup factors) corresponding to the selected course may be displayed on the sub-course input unit 40.

At this time, the user may drive the clothes treating apparatus 1 in accordance with the standard setup factors by directly pushing the execution button 33, or drive the clothes treating apparatus 1 by pushing the execution button 33 after changing the setup factors displayed on the sub-course input unit 40.

Hereinafter, detailed elements of the clothes treating apparatus will be described in detail with reference to FIG. 3.

Figure 3:
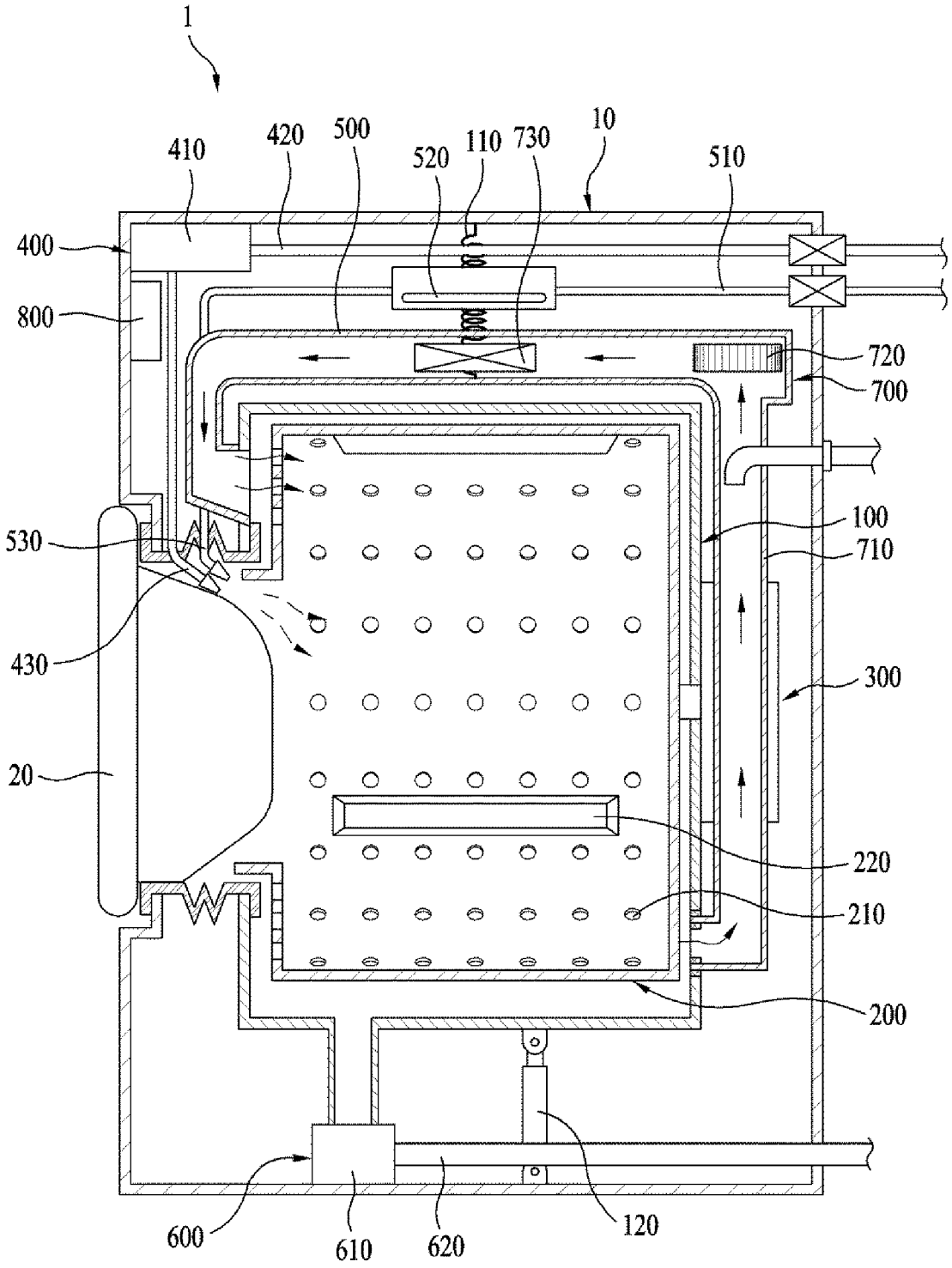
FIG. 3 is a side cross-sectional view illustrating a clothes treating apparatus according to the present invention.

FIG. 3 is a side cross-sectional view illustrating a clothes treating apparatus according to the present invention.

Figure 4:
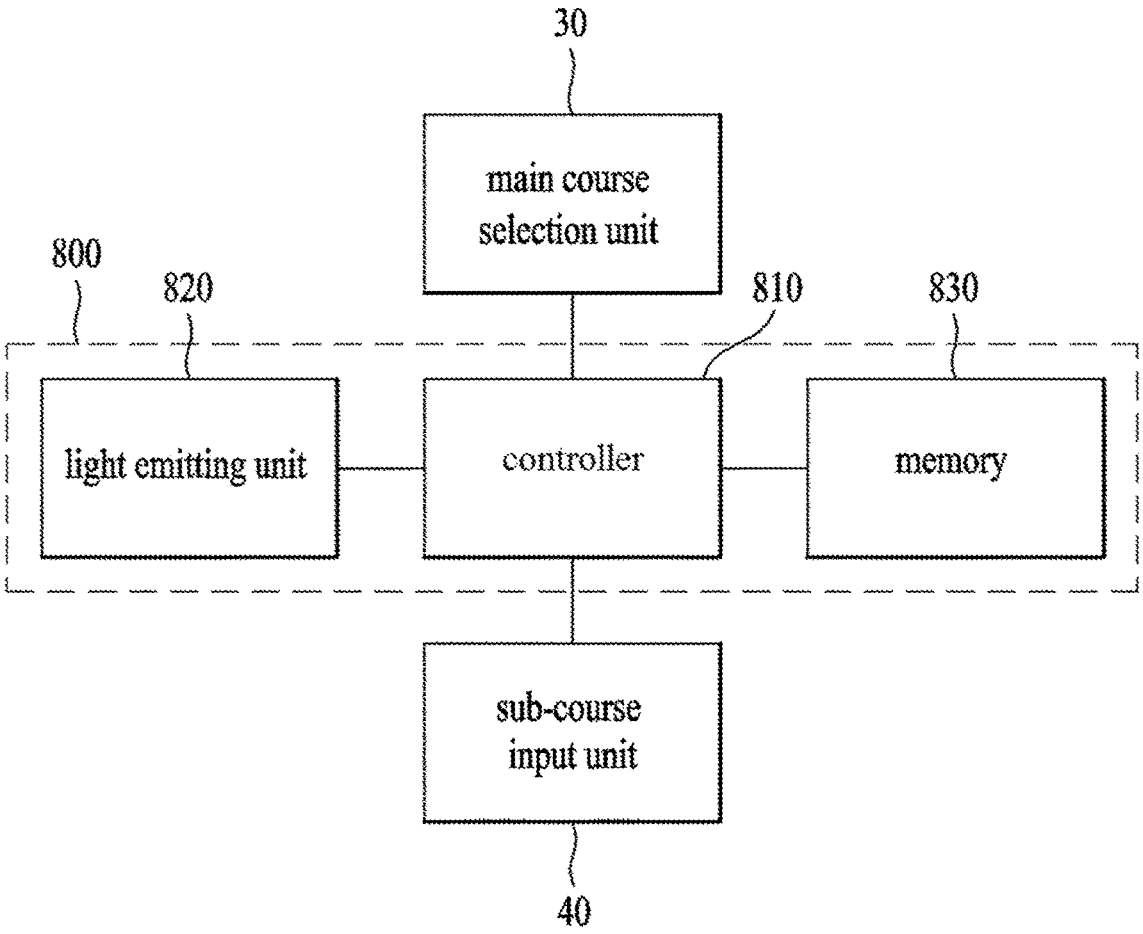
FIG. 4 is a block diagram briefly illustrating a control unit provided in a clothes treating apparatus according to the present invention.

Referring to FIG. 3, the clothes treating apparatus (that is, washing device) 1 may include a cabinet 10 forming external appearance, a tub 100 provided inside the cabinet 10, a drum 200 provided to be axially rotated inside the tub 100, receiving clothes therein, a driving unit 300 giving a rotational force to the drum 200, a detergent jet unit 400 jetting a detergent into the drum 200 in which clothes are received, a steam jet unit 500 jetting a steam into the drum 200, a discharge unit 600 for discharging out washing water or rinsing water, an air circulating unit 700 circulating the hot air or the cool air inside the tub 100, a control unit 800 for operating the clothes treating apparatus 1 by controlling each element, and a main course selection unit 30 and a sub-course input unit 40, which are associated with the control unit 800 to input a command for controlling each element (see FIG. 4).

The cabinet 10 forms external appearance of the washing device 1 according to this embodiment, and various elements, which will be described later, are mounted at an inner side and an outside of the cabinet 10. A door 20 for putting clothes into the drum is rotatably provided at the front of the cabinet 10.

The tub 100 is provided at the inner side of the cabinet 10, and has a cylindrical shape opened toward the door 20 provided in the cabinet 10. The tub 100 prevents the detergent from being leaked and at the same time is rotatably fixed to the drum 200.

In this case, the tub 100 is elastically supported by an upper spring 110 and a lower damper 120. The spring 110 and the damper 120 buffer and reduce transfer of vibration to the cabinet 10 through the tub 100, wherein the vibration is generated by rotation of the drum 200 in accordance with the operation of the driving unit 300.

The drum 200 is rotatably provided at the inner side of the tub 100. Clothes put toward the door 20 are stacked at the inner side of the drum 200. The drum 200 is provided with a plurality of drainage holes 210 through which the detergent passes. A plurality of protrusions 220 are formed at the inner side of the drum 200, wherein the protrusions hold the clothes staked in the drum 200 when the drum 200 is rotated and drop the clothes after ascending the clothes. Mixing performance of the detergent and the clothes may be improved by movement of the clothes by the protrusions 220.

Also, the driving unit 300 for rotating the drum 200 is mounted on the rear surface of the tub 20. The driving unit 300 is formed of a motor to rotate the drum 200. The rotational speed of the driving unit 300 is controlled under the control of the control unit 800. A structure and type of the driving unit 300 is widely known in the person skilled in the art, and their various embodiments can be achieved and thus their detailed description will be omitted.

The detergent jet unit 400 is provided outside the tub 100, and jets the detergent toward the drum 200 located at the inner side of the tub 100. The detergent jet unit 400 jets the detergent only, or jets water, which is separately supplied, and the detergent by mixture. In this case, a functional detergent is preferably provided as a liquefied detergent that includes water soluble component only to be dissolved in water which is supplied.

The detergent jet unit 400 includes a detergent storage tub 410 where the detergent is stored, a dilution water supply line 420 for supplying dilution water for diluting the functional detergent, a pressure pump (not shown) for supplying the functional detergent diluted by the dilution water at a predetermined pressure, and a jet nozzle 430 for jetting the functional detergent supplied by the pressure pump toward the inner side of the drum 200.

The steam jet unit 500 is to improve a contaminant material binding force of the functional detergent permeated into the clothes by jetting steam of high temperature toward the clothes received in the drum 200. The steam jet unit 500 includes a steam water supply pipe 510 for supplying steam water for generating steam, a steam generator 520 for forming steam by heating the steam water supplied from the steam water supply pipe 510, and a steam jet nozzle 530 for jetting the steam generated by the steam generator 520 toward the clothes at the front of the drum 200.

The discharge unit 600 is provided at the outer side of the tub 100 to discharge washing water or rinsing water inside the tub 100. The discharge unit 600 includes a drainage pump 610 and a drainage pipe 620.

The air circulating unit 700 is provided on the outer circumference of the tub 100 to inhale the air inside the tub 100 or the external air of the clothes treating apparatus 1, thereby circulating the hot air or the cool air toward the inner side of the tub 100.

The air circulating unit 700 includes a circulating duct 710 forming a moving path to supply the air from an upper side at the front of the tub 100 to a lower side at the rear of the tub 100, a ventilating fan 720 for circulating the air inside the circulating duct 710, and a heat exchanger 730 heating or cooling the ventilated air to make the hot air or the cool air.

In this case, the heat exchanger 730 may be provided as a heating device (for example, heater, not shown) for heating the air and a cooling device (for example, thermoelectric element, not shown) for cooling the air.

Hereinafter, detailed features of the control unit 800, the main course selection unit 30 and the sub-course input unit 40, which are provided in the clothes treating apparatus of the present invention, will be described with reference to FIG. 4.

Referring to FIGS. 2 and 4, the control unit 800 provided in the clothes treating apparatus 1 according to the embodiment of the present invention may include a controller 810 for controlling the main course selection unit 30 and the sub-course input unit 40, a light emitting unit 820 for sequentially or selectively lighting the plurality of courses A to L and the indicator lights 35 displayed on the main course selection unit 30, and a memory 830 for storing the information input through the main course selection unit 30 and the sub-course input unit 40.

In more detail, the controller 810 receives information input to the main course selection unit 30 and the sub-course input unit 40 by the user, and drives the respective elements of the clothes treating apparatus 1 in accordance with the received information and at the same time transfers the corresponding information to the memory 830.

The controller 810 may control the light emitting unit 820 to wholly or selectively light (or activate) the plurality of courses A to L displayed on the main course selection unit 30.

If the plurality of course A to L provided in the main course selection unit 30 are wholly lighted, the user may select a desired one of the plurality of course A to L by manipulating (that is, rotating) the manipulation unit 32.

For example, if the power source is input to the clothes treating apparatus 1, the indicator light 35 provided at the position corresponding to the first course 'A' of the plurality of courses A to L provided in the main course selection unit 30 is lighted. At this time, if the user rotates the manipulation unit 32 at a predetermined angle clockwise or counterclockwise, the indicator light 35 provided at the position corresponding to another course 'B' or 'L' adjacent to the first course 'A' clockwise or counterclockwise may be lighted.

Also, the number of selection times of the course selected through the main course selection unit 30 is recorded in the memory 830.

Meanwhile, if the controller 810 determines that one or more of the plurality of courses A to L provided in the main course selection unit 30 are selected through the main course selection unit 30 as much as the number of predetermined times or more for a predetermined period, the controller 810 may control the main course selection unit 30 to display only the one or more courses on the main course selection unit 30.

That is, the controller 810 may control the light emitting unit 820 to light only the one or more of the plurality of courses A to L displayed on the display unit 34 of the main course selection unit 30, which are selected as much as the number of predetermined times or more for a predetermined period.

For example, if the power source is input to the clothes treating apparatus 1, the controller 810 determines whether one or more courses are selected through the main course selection unit 30 as much as the number of predetermined times or more for a predetermined period. If such courses are selected, the controller 810 displays a text indicating "customized course mode" on the display unit 34.

The controller 810 may receive information of the predetermined period and information of the number of selection times of the courses selected through the main course selection unit 30 for the predetermined period from the memory 830.

Also, the predetermined period may be counted inversely from the time when the power source is input to the clothes treating apparatus 1. That is, the predetermined period may be set in the controller, so as to be counted to a timing such as before one month, before two months, . . . or before one year from the time when the power source is input to the clothes treating apparatus 1.

In more detail, before one month, before two months, . . . or before one year from the time when the power source is input to the clothes treating apparatus 1 becomes a counting point for determining the predetermined period.

Therefore, the controller 810 may control the light emitting unit 820 such that only the courses selected as much as the number of predetermined times or more are selectively lighted by the light emitting unit 820 for a period (that is, predetermined period) from the time when the power source is input to the clothes treating apparatus 1 to the counting point and then displayed on the display unit 34.

At this time, the controller 810 may control the course selection unit 30 to select one of the courses selectively lighted by the light emitting unit 810 in accordance with rotation of the manipulation unit 32.

In this case, the number of predetermined times such as 5 times or more, 7 times or more, 10 times or more, . . . , 15 times or more may be set to the controller 810.

In more detail, if only the courses selected as much as the number of predetermines times for the predetermined period are displayed on the display unit 34 (that is, in customized course mode), the user may select a desired one of the displayed courses by rotating the manipulation unit 32.

That is, if the controller 810 determines that the courses are selected as much as the number of predetermined times or more for the predetermined period, the controller 810 controls the light emitting unit 820 to display only the courses determined by the controller 810 on the display unit 34.

At this time, if the user rotates the manipulation unit 32 at a predetermined angle clockwise or counterclockwise, the indicator lights 35 provided at the positions corresponding to the courses determined by the controller 810 may be sequentially lighted clockwise or counterclockwise.

Meanwhile, even though only the courses determined by the controller 810 are displayed on the display unit 34 of the main course selection unit 30, the light emitting unit 820 may be controlled by the controller 810 such that all of the plurality of courses provided in the main course selection unit 30 may be lighted by the light emitting unit 820 in accordance with rotation of the manipulation unit 32 at a predetermined angle or more.

For example, if the manipulation unit 32 is rotated clockwise or counterclockwise, the light emitting unit 820 may be controlled by the controller 810 such that all of the plurality of courses provided in the main course selection unit 30 may be lighted by the light emitting unit 820.

Also, when only the courses determined by the controller 810 are displayed on the display unit 34 of the main course selection unit 30 and the indicator lights 35 corresponding to the displayed courses are lighted once by rotation of the manipulation unit 32 and the indicator light 35 corresponding to the position where the first indicator light 35 is lighted is again lighted, the light emitting unit 820 may be controlled by the controller 810 such that all of the plurality of courses provided in the main course selection unit 30 may be lighted by the light emitting unit 820 (that is, customized course mode may be released).

That is, if the manipulation unit 32 is rotated at a predetermined angle (for example, 360° or rotational angle that allows the indicator lights adjacent to each other to be lighted once in accordance with rotation of the manipulation unit 32) or more, the customized course mode is released.

Hereinafter, features that the main course selection unit 30 is set to the customized course mode will be described in detail with reference to FIG. 5.

Figure 5:
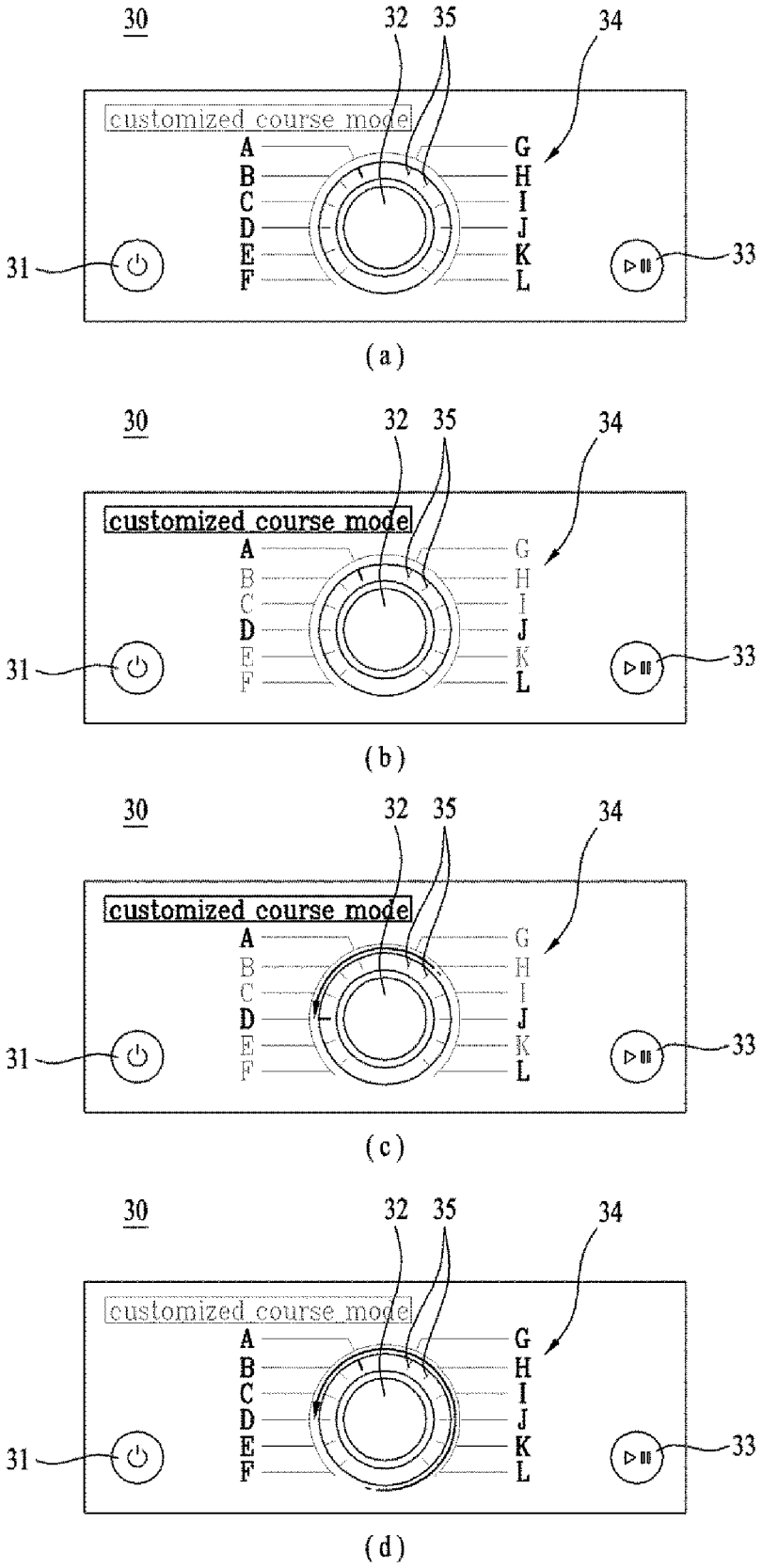
FIG. 5 shows views illustrating a plurality of courses displayed on a main course selection unit.

FIGS. 5(*a*) to 5(*d*) are views illustrating a plurality of courses displayed on a main course selection unit.

In more detail, FIG. 5(*a*) illustrates the main course selection unit 30 when the clothes treating apparatus 1 is first used or the controller 810 determines that there are no courses selected through the main course selection unit 30 as much as the number of predetermined times or more for a predetermine period.

Referring to FIG. 5(*a*), if a power source is supplied to the clothes treating apparatus 1, the controller 810 determines whether there are courses selected through the main course selection unit 30 as much as the number of predetermined times or more for a predetermined period.

If it is determined there are no courses selected through the main course selection unit 30 as much as the number of predetermined times or more for a predetermined period, the plurality of courses A to L provided in the display unit 34 of the main course selection unit 30 are all lighted by the light emitting unit 820.

At this time, the user may select a desired course by rotating the manipulation unit 32. For example, the plurality of indicator lights 35 provided between the manipulation unit 32 and the plurality of courses A to L may be lighted sequentially in accordance with rotation of the manipulation unit 32.

If the indicator light 35 provided at the position corresponding to the course desired by the user is lighted, the user may drive the clothes treating apparatus 1 by pushing the execution button 33.

FIG. 5(*b*) illustrates the main course selection unit 30 when the controller 810 determines that there are courses selected through the main course selection unit 30 as much as the number of predetermined times or more for a predetermine period (that is, in a customized course mode).

Referring to FIG. 5(*b*), if a power source is supplied to the clothes treating apparatus 1, the controller 810 determines whether there are courses (hereinafter, referred to as "customized courses") selected through the main course selection unit 30 as much as the number of predetermined times or more for a predetermined period.

If it is determined there are courses selected through the main course selection unit 30 as much as the number of predetermined times or more for a predetermined period, the customized courses A, D, G and I of the plurality of courses A to L provided in the display unit 34 of the main course selection unit 30 are selectively lighted by the light emitting unit 820. That is, only the customized courses A, D, G and I are lighted by the light emitting unit 820 and displayed on the display unit 34.

Also, a text indicating "customized course mode" may be displayed on the display unit 34.

At this time, the user may select a desired one of the customized courses A, D, G and I lighted by the light emitting unit 820 and displayed on the display unit 34 in accordance with rotation of the manipulation unit 32. For example, one or more indicator lights 35 provided between the manipulation unit 32 and one or more customized courses A, D, G and I may be lighted sequentially in accordance with rotation of the manipulation unit 32.

If the indicator lights 35 provided at the positions corresponding to one or more of the customized courses A, D, G and I, which are desired by the user, are lighted, the user may drive the clothes treating apparatus 1 by pushing the execution button 33.

Of course, if one customized course is determined by the controller 810, one indicator light 35 provided at the position corresponding to the corresponding customized course may be lighted.

FIG. 5(*c*) illustrates that a desired course is selected through the main course selection unit 30 when the controller 810 determines that there are courses selected through the main course selection unit 30 as much as the number of predetermined times or more for a predetermine period (that is, in a customized course mode).

Referring to FIG. 5(*c*), the user may rotate the manipulation unit 32 clockwise or counterclockwise to select a desired course of the customized courses A, D, G and I displayed on the display unit 34.

At this time, the light emitting unit 820 may sequentially light the indicator lights 35 provided at the positions corresponding to the customized courses A, D, G and I in accordance with rotation of the manipulation unit 32.

And, the user may drive the clothes treating apparatus 1 by pushing the execution button 33 if the indicator light 35 provided at the position corresponding to the desired course is lighted.

FIG. 5(*d*) illustrates the main course selection unit 30 in a state that the customized course mode is released.

In the same manner as FIGS. 5(*b*) and 5(*c*), as the controller 810 determines that there are courses selected through the main course selection unit 30 as much as the number of predetermined times or more for a predetermine period, even if the customized courses A, D, G and I are displayed on the display unit 34, the user may release the customized course mode and select a desired one of all the courses.

That is, after a power source is supplied to the clothes treating apparatus 1, if only the customized courses A, D, G and I are displayed on the display unit 34, the user may release the customized course mode by rotating the manipulation unit 32 at a predetermined angle or more.

For example, the controller 810 may control the main course selection unit 30 to release the customized course mode if the manipulation unit 32 is rotated at 360° or more.

Also, the controller 810 may control the main course selection unit 30 to release the customized course mode if the indicator lights 35 corresponding to the customized courses displayed on the display unit 34 are sequentially lighted once by rotation of the manipulation unit 32 and the initially lighted indicator light 35 is lighted again.

For example, if a power source is supplied to the clothes treating apparatus 1, the customized courses A, D, G and I may be displayed on the display unit 34, and the indicator light 35 at the position corresponding to the first course A may be lighted. At this time, the user may allow the indicator lights 35 provided at the positions corresponding to the courses D, G and I to be lighted by rotating the manipulation unit 32. At this time, if the indicator light 35 at the position corresponding to the course A is lighted by additional rotation of the user, the main course selection unit 30 may be controlled by the controller 810 such that the customized course mode may be released.

If the customized course mode is released, all the plurality of courses A to L are lighted (that is, displayed) on the display unit 34 by the light emitting unit 820. The user may select a desired one of the plurality of courses A to L through rotation of the manipulation unit 32.

This is to allow the user to select a course, which is not used frequently, if desired through a simple manipulation of the manipulation unit 32.

Meanwhile, the main course selection unit 30 may be provided with a button for customized course mode setup and a button for customized course mode release. In this case, the user may set or release the customized course mode by pushing the button for customized course mode setup and the button for customized course mode release.

Hereinafter, the customized course mode applied to the sub-course input unit 40 will be described with reference to FIG. 6.

Figure 6:
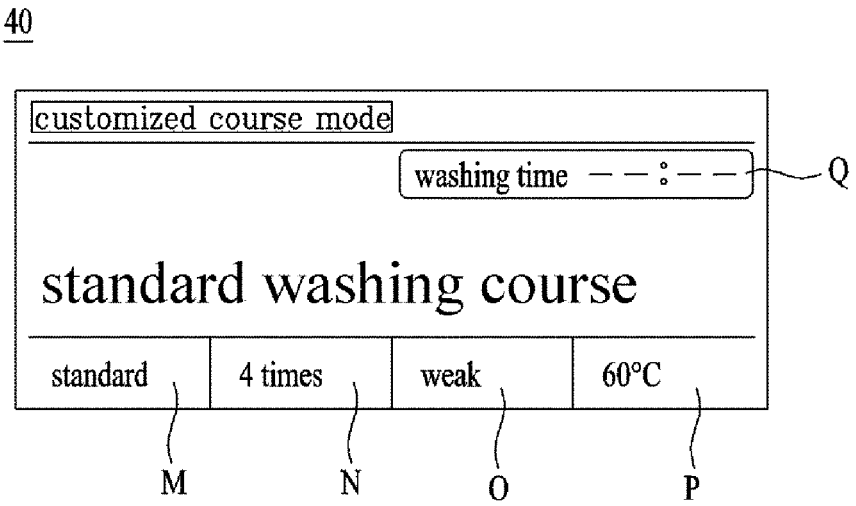
FIG. 6 is a view illustrating one embodiment of a sub-course input unit.

FIG. 6 is a view illustrating one embodiment of a sub-course input unit 40. One course selected by the main course selection unit 30 and additional setup factors for executing the selected course may be displayed on the sub-course input unit 40.

For example, the setup factors such as washing strength 'M', the number of rinsing times 'N', dehydrating strength 'O', water (washing water/rinsing water) temperature 'P' and washing time 'Q' may be displayed on the sub-course input unit 40.

The sub-course input unit 40 may be formed in a touch screen shape that may input or change information of the setup factors through a touch based on a finger of the user. Of course, the sub-course input unit 40 may be provided with a separate button (not shown) for input or change of the information of the setup factors.

Therefore, the user may input or change the setup factors such as washing strength 'M', the number of rinsing times 'N', dehydrating strength 'O', and water temperature 'P' through the sub-course input unit 40.

Meanwhile, if one course is selected through the main course selection unit 30, the controller 810 determines whether there are setup factors input through the sub-course input unit 40 as much as the number of predetermined times or more for a predetermined period.

If it is determined that there are setup factors input through the sub-course input unit 40 as much as the number of predetermined times or more for a predetermined period, the controller 810 controls the sub-course input unit 40 to first display the setup factors on the sub-course input unit 40 (hereinafter, referred to as "customized setup factor mode").

At this time, the user may drive the clothes treating apparatus 1 in accordance with the setup factors first displayed by pushing the execution button 33. Of course, after changing or re-inputting the setup factors, the user may drive the clothes treating apparatus 1 in accordance with the changed or re-input setup factors by pushing the execution button 33.

The predetermined period and the number of predetermined times may be set in the same manner as the predetermined period and the number of predetermined times described with reference to the main course selection unit 30.

Moreover, the setup factors first displayed on the sub-course input unit 40 may be executed in accordance with the customized course mode executed by the aforementioned main course selection unit 30 or may be executed separately regardless of the customized course mode executed by the main course selection unit 30.

That is, the customized setup factor mode executed by the sub-course input unit 40 may be executed depending on whether the customized course mode is executed by the main course selection unit 30 (that is, customized setup factor mode is executed only if the customized course mode is executed).

Unlike the above case, the customized setup factor mode executed by the sub-course input unit 40 may be executed regardless of the point whether the customized course mode is executed by the main course selection unit 30 (that is, customized setup factor mode is executed even though the customized course mode is not executed).

Also, if the customized setup factor mode is executed, a text indicating "customized setup factor mode" may be displayed on the sub-course input unit 40. Of course, execution of "the customized setup factor mode" may be notified to the user by voice together with the text indicating "customized setup factor mode" or without the text indicating "customized setup factor mode". The display of the text and voice support may be controlled through the controller 810.

Meanwhile, if the controller 810 determines whether there are no setup factors input through the sub-course input unit 40 as much as the number of predetermined times or more for a predetermined period, standard setup factors may be displayed on the sub-course input unit 40. Since the standard setup factors are the same as those described with reference to FIG. 2, their detailed description will be omitted.

Figure 7:
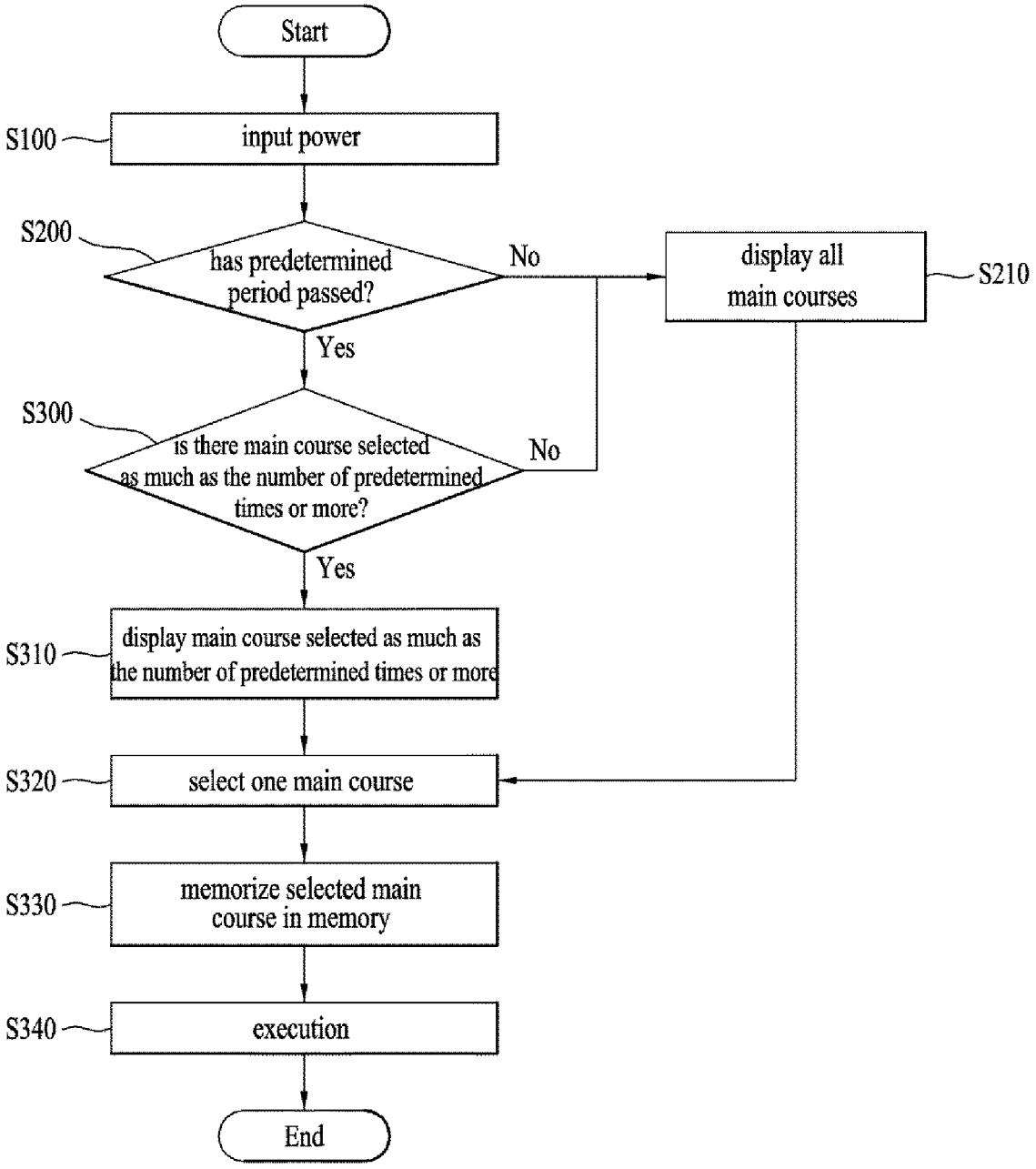
FIG. 7 is a flow chart illustrating a method for controlling a clothes treating apparatus according to the present invention.

FIG. 7 is a flow chart illustrating a method for controlling a clothes treating apparatus according to the present invention. Hereinafter, in description of the method for controlling a clothes treating apparatus, it will be apparent that the elements of the clothes treating apparatus described with reference to FIGS. 1 to 6 may equally be applied to the method for controlling the clothes treating apparatus.

Referring to FIG. 7, the method for controlling the clothes treating apparatus according to one embodiment of the present invention includes a power input step S100 for supplying a power source to the clothes treating apparatus, a display step S310 for displaying one or more main courses selected through the main course selection unit on the main source selection unit as much as the number of predetermined times or more for a predetermined period, and a selection step S320 for selecting one of the one or more displayed main courses through rotation of the manipulation unit provided in the main course selection unit.

Also, the method for controlling the clothes treating apparatus may further comprise a period determining step S200 for determining in the controller whether a predetermined period has passed after a first operation of the clothes treating apparatus, and the number of times determining step 300 for determining in the controller whether there are main courses selected as much as the number of predetermined times or more for the predetermined period if the predetermined period has passed, before the display step S310 (that is, between the power input step S100 and the display step S310).

That is, if it is determined that the predetermined period has passed at the period determining step S200 and if it is determined that there are one or more main courses selected as much as the number of predetermined times or more at the number of times determining step S300, the one or more main courses selected as much as the number of predetermined times or more may be displayed on the main course selection unit (S310). That is, the customized course mode may be executed.

If the customized course mode is executed, a text indicating "customized course mode" may be displayed on the main course selection unit. Of course, execution of the customized course mode may be notified to the user through voice.

At this time, one of the one or more displayed main courses may be selected by the user (S320), and the main course selected by the user may be memorized in the memory (S330). And, the user may drive the clothes treating apparatus in accordance with the selected main course by pushing the execution button (S340).

Meanwhile, if it is determined that the predetermined period has not passed at the period determining step S200, or if it is determined that there are no one or more main courses selected as much as the number of predetermined times or more at the number of times determining step S300, all the main courses are displayed on the main course selection unit (S210).

The user may select one of all the main courses which are displayed (S320), and the main course selected by the user may be memorized in the memory (S330). And, the user may drive the clothes treating apparatus in accordance with the main course selected by the user among all the main courses by pushing the execution button (S340).

That is, the method for controlling the clothes treating apparatus according to the embodiment of the present invention may further include a memorizing step S330 for memorizing the main course selected at the selection step S320 in the memory, after the selection step S320.

As described above, one or more frequently used courses of the plurality of courses provided in the clothes treating apparatus may be displayed on the course selection unit, whereby manipulation convenience of the user may be increased, and the manipulation time of the clothes treating apparatus by the user may be reduced.

Also, according to the present invention, frequently input setup factors of the plurality of setup factors according to the selected course may be displayed on the sub-course input unit, whereby manipulation convenience of the user may be increased. Also, a family member who does not use the clothes treating apparatus frequently can easily use the clothes treating apparatus.

Meanwhile, after the selection display step S310 for displaying the one or more main courses selected as much as the number of predetermined times or more for the predetermined period on the main course selection unit, if the manipulation unit provided in the main course selection unit is rotated at a predetermined angle or more, all of the plurality of main courses displayed on the main course selection unit may be displayed (that is, customized course mode may be released).

At this time, the predetermined angle may be 360°. That is, the user may release the customized course mode by rotating the manipulation unit at 360° and display all the plurality of main courses on the main course selection unit.

The customized course mode allows the user to conveniently select a course frequently used by the user while increasing selection convenience of the user if the user desires to use a new course which is not used frequently.

That is, even though the customized course mode is executed as the controller determines that there are one or more main courses selected as much as the number of predetermined times or more for the predetermined period, the user may simply release the customized course mode by rotating the manipulation unit at a predetermined angle or more.

In a method for releasing the customized course mode, the customized course mode may be configured to be released if the manipulation unit is rotated at 360° clockwise or counterclockwise. This method may be applied to both the case that all the courses are displayed and the case that only the courses selected as much as the number of predetermined times or more for the predetermined period.

Meanwhile, even though the manipulation unit is rotated at 360° clockwise or counterclockwise, if the courses displayed from the course first indicated by the manipulation unit are rotated once by rotation of the manipulation unit and then the course mode again returns to the course first indicated by the manipulation unit, the customized course mode may be released.

That is, if the manipulation unit is rotated from a state (that is, a state that a specific course is selected by the manipulation unit) before the manipulation unit is rotated to reach all the displayed courses, and then is again rotated to the position for initially selecting the specific course, the customized course mode may be configured to be released.

Meanwhile, the method for controlling the clothes treating apparatus according to the present invention is characterized in that repeatedly input setup factors of setup factors (the number of rinsing times, dehydrating strength, etc.) according to the respective main courses are memorized and displayed. This characteristic will be described in detail with reference to FIG. 8.

Figure 8:
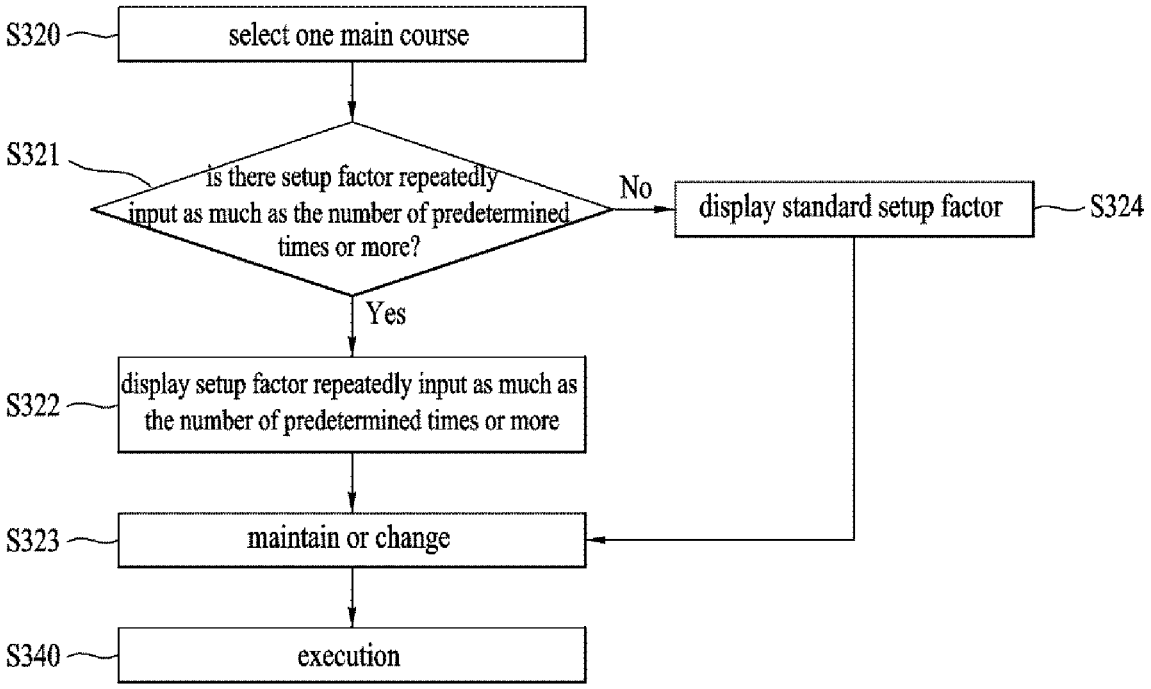
FIG. 8 is a flow chart added to FIG. 7 to illustrate a method for controlling a clothes treating apparatus according to the present invention.

FIG. 8 is a flow chart added to FIG. 7 to illustrate a method for controlling a clothes treating apparatus according to the present invention.

Referring to FIG. 8, the method for controlling a clothes treating apparatus according to the present invention may further include a setup factor determining step S321 for determining in the controller whether there are setup factors repeatedly input as much as the number of predetermined times or more in setup factors added to the selected main course after the step S320 for selecting one of the one or more displayed main courses.

At this time, the main course may include at least one or more of a standard washing course, a baby clothes course, a boiling course, a speed wash course, an allergy care course, a steam cleaning course, a functional clothes course, a bedding cleaning course, a cool water washing course, a lingerie/wool course, a bedding course, and ring/dehydrating courses, and the setup factors may include at least one or more of the number of rinsing times, dehydrating strength and water temperature.

That is, even though the user selects the main course, the user may input or change the above setup factors.

The controller determines whether there are setup factors repeatedly input as much as the number of predetermined times or more in the setup factors used (that is, input) by the user (S321).

If the controller determines that there are setup factors repeatedly input as much as the number of predetermined times or more, the repeatedly input setup factors are displayed on the sub-course input unit (S322), and the user may operate the clothes treating apparatus through the setup factors displayed on the sub-course input unit by pushing the execution button (S340).

At this time, even though the repeatedly input setup factors are displayed on the sub-course input unit, the user may determine whether to maintain or change the setup factors (S323).

That is, if the repeatedly input setup factors are displayed on the sub-course input unit, the user may operate the clothes treating apparatus by pushing the execution button if desired to operate the clothes treating apparatus through the setup factors.

On the other hand, if the user does not desire to operate the clothes treating apparatus through the setup factors (that is, if the user desires to change the setup factors), the user may push the execution button after inputting, re-inputting or changing the setup factors through the sub-course input unit, so as to operate the clothes treating apparatus through the newly input and/or changed setup factors.

Meanwhile, if the controller determines that there are no setup factors repeatedly input as much as the number of predetermined times or more, previously set standard setup factors are displayed on the sub-course input unit (S324). Even at this time, the user may determine whether to maintain or change the standard setup factors (S323).

That is, the user may operate the clothes treating apparatus by pushing the execution button if desired to operate the clothes treating apparatus through the standard setup factors.

On the other hand, if the user does not desire to operate the clothes treating apparatus through the standard setup factors (that is, if the user desires to change the setup factors), the user may push the execution button after inputting, re-inputting or changing the setup factors through the sub-course input unit, so as to operate the clothes treating apparatus through the newly input and/or changed setup factors.

As described above, the frequently used (input) main courses and setup factors may be displayed on the main course selection unit and the sub-course input unit, whereby convenience of the user may be increased and the manipulation time of the clothes treating apparatus by the user may be reduced.

Meanwhile, the controller may receive the information of the number of selection times of the main course selected through the main course selection unit and the information of the number of repeatedly input times of the setup factors input through the sub-course input unit from the memory for the predetermined period.

The present invention is not limited to the aforementioned embodiments, and it will be apparent to those skilled in the art that the present invention can be embodied in other specific forms without departing from the spirit and essential characteristics of the invention. The scope of the invention should be determined by reasonable interpretation of the appended claims and all change which comes within the equivalent scope of the specification are included in the scope of the invention.

The invention claimed is:

1. A method for controlling a clothes treating apparatus comprising a manipulation knob, a main course selection interface having data identify a plurality of courses displayed on a circumference of the manipulation knob, a memory to store information identifying numbers of times each of the plurality of courses is selected through the main course selection interface, and a controller to drive the clothes treating apparatus in accordance with an input received through the manipulation knob, the method comprising the steps of:

activating the clothes treating apparatus;

determining whether one or more of the courses were previously selected through the main course selection interface a prescribed number of times or more during a prescribed period;

displaying the one or more of the courses which were previously selected through the main course selection interface the prescribed number of times or more during the prescribed period;

receiving a selection of one of the one or more displayed courses through rotation of the manipulation knob, wherein the controller drives the clothes treating apparatus based on the selection;

after displaying the one or more courses selected the prescribed number of times or more on the main course selection interface, determining when the manipulation knob is rotated by a prescribed angle or more; and modifying, when the manipulation knob is rotated by a prescribed angle or more, the main course selection interface such that all of the plurality of courses are concurrently displayed on the main course selection interface.

2. The method for controlling the clothes treating apparatus according to claim 1, further comprising:

determining by the controller, when the clothes treating apparatus is activated, whether the prescribed period has passed after a first operation of the clothes treating apparatus, and identifying by the controller the one or more courses selected the prescribed number of times or more during the prescribed period based on determining that the prescribed period has passed after the first operation of the clothes treating apparatus.

3. The method for controlling the clothes treating apparatus according to claim 1, further comprising updating the memory based on the selection.

4. The method for controlling clothes treating apparatus according to claim 1, further comprising:

displaying all of the courses on the main course selection interface when the prescribed period has not passed or there are no courses selected the prescribed number of times or more;

receiving the selection of one of all the displayed courses; and updating the memory based on the selection.

5. The method for controlling the clothes treating apparatus according to claim 1, wherein the prescribed angle is 360°.

6. The method for controlling the clothes treating apparatus according to claim 1, further comprising:

determining through the controller whether there are one or more setup factors selected a prescribed number of times or more for the courses.

7. The method for controlling the clothes treating apparatus according to claim 6, further comprising:

displaying the one or more setup factors on a sub-course input interface; and operating the clothes treating apparatus through the one or more setup factors displayed on the sub-course input interface.

8. The method for controlling the clothes treating apparatus according to claim 6, wherein, if there are no setup factors selected the prescribed number of times or more, the method further comprises:

displaying at least one previously set setup factor on a sub-course input interface; and operating the clothes treating apparatus through the at least one previously set setup factors.

9. The method for controlling the clothes treating apparatus according to claim 7, further comprising:

receiving an input from a user to modify at least one of the one or more displayed setup factors; and operating the clothes treating apparatus based on the modified setup factors.

10. The method for controlling the clothes treating apparatus according to claim 1, wherein:

the main course selection interface includes a plurality of lights associated with the plurality of courses, displaying the one or more of the courses which were previously selected through the main course selection interface the prescribed number of times or more during the prescribed period includes concurrently activating a first subset of the lights associated with the one or more of the courses without activating a second subset of the lights that are not associated with the one or more of the courses, and modifying the main course selection interface such that all of the plurality of courses are concurrently displayed on the main course selection interface includes concurrently activating the plurality of lights.

* * * * *